US007469818B2

(12) United States Patent
Saltsov et al.

(10) Patent No.: US 7,469,818 B2
(45) Date of Patent: Dec. 30, 2008

(54) BANKNOTE ACCEPTOR WITH REMOVABLE STACKER

(75) Inventors: Leon Saltsov, Thornhill (CA); Dmitro Baydin, Etobicoke (CA); Yuriy Rusakov, Aurora (CA); Sergiy Androsyuk, Etobicoke (CA); Oleksandr Lukonin, Etobicoke (CA)

(73) Assignee: Crane Canada Co., Concord, ON (CA)

( * ) Notice: Subject to any disclaimer, the term of this patent is extended or adjusted under 35 U.S.C. 154(b) by 0 days.

(21) Appl. No.: 11/808,425

(22) Filed: Jun. 11, 2007

(65) Prior Publication Data

US 2008/0265012 A1 Oct. 30, 2008

(51) Int. Cl.
*G07B 15/00* (2006.01)

(52) U.S. Cl. ..... 232/16; 194/206; 271/3.01; 271/180

(58) Field of Classification Search ..... 232/15–16, 232/1 D; 194/206; 235/379; 271/180–181, 271/3.01
See application file for complete search history.

(56) References Cited

U.S. PATENT DOCUMENTS 5,209,335 A * 5/1993 Shuren et al. ..... 194/200
5,405,131 A * 4/1995 Zouzoulas ..... 271/181
5,653,436 A * 8/1997 Zouzoulas ..... 271/177
5,662,202 A * 9/1997 Suris ..... 194/206
6,199,856 B1 * 3/2001 Clauser et al. ..... 271/180
6,371,473 B1 * 4/2002 Saltsov et al. ..... 271/3.01
6,712,352 B2 * 3/2004 Bergeron et al. ..... 271/180
7,051,926 B2 * 5/2006 Saltsov et al. ..... 235/379
2004/0155102 A1 * 8/2004 Bergeron et al. ..... 235/379
2004/0213620 A1 * 10/2004 Bergeron et al. ..... 400/668
2005/0183926 A1 * 8/2005 Deaville et al. ..... 194/206
2006/0214350 A1 * 9/2006 Saltsov et al. ..... 271/3.01

* cited by examiner

*Primary Examiner*—William L. Miller

(57) ABSTRACT

A banknote acceptor includes a validator, a removable banknote stacker and a removable non locked banknote cassette. The removable banknote stacker, when secured in the banknote acceptor, is operable by a drive member of the acceptor that remains with the acceptor when the removable banknote stacker is removed. With this arrangement, any operation problems of the removable stacker are easily overcome by replacement of the stacker. Preferably, the banknote acceptor, with the stacker removed, is able to receive and function with a locked banknote cassette having a stacker mechanism internal to the cassette.

7 Claims, 6 Drawing Sheets

BANKNOTE ACCEPTOR WITH REMOVABLE STACKER

FIELD OF THE INVENTION

The present invention relates to banknote acceptors and in particular, to a banknote acceptor that includes a removable stacking mechanism for cooperation with a removable banknote cassette.

BACKGROUND OF THE INVENTION

Banknote acceptors typically include a banknote validator that cooperates with a removable banknote cassette that stores accepted banknotes in a stacked manner. Many of the banknote acceptors include a removable metal or plastic banknote cassette that is lockable. In this way, the banknote cassette can be removed from the banknote acceptor and any banknotes received in the banknote cassette are not accessible. Typically, these lockable banknote cassettes are taken to a secure facility and the banknote cassettes are unlocked and the banknotes counted and processed.

Typically, the removable banknote cassette that is lockable includes its own internal stacking mechanism that is typically driven by a drive member of the banknote acceptor. The drive member can include a rack and gear arrangement or a cam arrangement that typically drives a scissor bar type mechanism within the banknote cassette to add a received banknote to a stack of banknotes within the cassette.

For some applications, the banknote acceptor does not require the additional cost of a lockable banknote cassette. Some banknote acceptors include a stacking mechanism as part of the actual banknote acceptor that cooperates with a non lockable banknote cassette. These non lockable banknote cassettes are received in the banknote acceptor and one side of the banknote cassette is basically open. A received banknote is forced through this large opening and stacked within the removable cassette. When the cassette is removed, the last stacked banknote is exposed within the large port of the cassette. It is common practice to have such open or unlocked cassettes made of a plastic material as there is no requirement for the housing of the cassette to provide security as the stacked banknotes are easily accessed through the open port.

The present invention provides a number of improvements to banknote acceptors and provides additional flexibility with respect to such banknote acceptors.

SUMMARY OF THE INVENTION

A banknote acceptor according to the present invention comprises a validator, a removable banknote stacker supported below said validator and positioned to receive banknotes accepted by said validator. The banknote acceptor further includes a non locked banknote cassette releasably engagable with said banknote acceptor and cooperates with the removable banknote stacker to receive an accepted banknote from said validator in an initial position intermediate said removable banknote stacker and said cassette with the accepted banknote movable by operation of said removable banknote stacker into said cassette; said removable banknote stacker being actuated by a drive member secured in said banknote acceptor independent of said removable banknote stacker.

In a preferred embodiment of the invention the removable banknote stacker includes a spring latch securement to a body frame of the banknote acceptor.

In an aspect of the invention, the non locked banknote cassette is releasably secured to the removable banknote stacker.

In a further aspect of the invention, the non locked plastic cassette includes securing lugs received in securing ports of the removable banknote stacker in combination with a manually releasable spring latch to releasably secure said non locked cassette to said removable stacker.

In a different aspect of the invention, the banknote acceptor includes a body frame that supports the validator and the removable banknote stacker. The body frame with the removable banknote stacker removed includes securing ports for releasably engaging a locked banknote cassette having a stacker mechanism internal to said locked banknote cassette.

According to an aspect of the invention, the releasable stacker has a majority of injected molded plastic components.

In a further aspect of the invention, the removable banknote stacker includes opposed side members with each side member including first and second lock slots. The non locked plastic cassette includes side securing lugs receivable in the first and second securing slots to form part of the releasable securement of the non locked plastic cassette to the removable banknote stacker.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
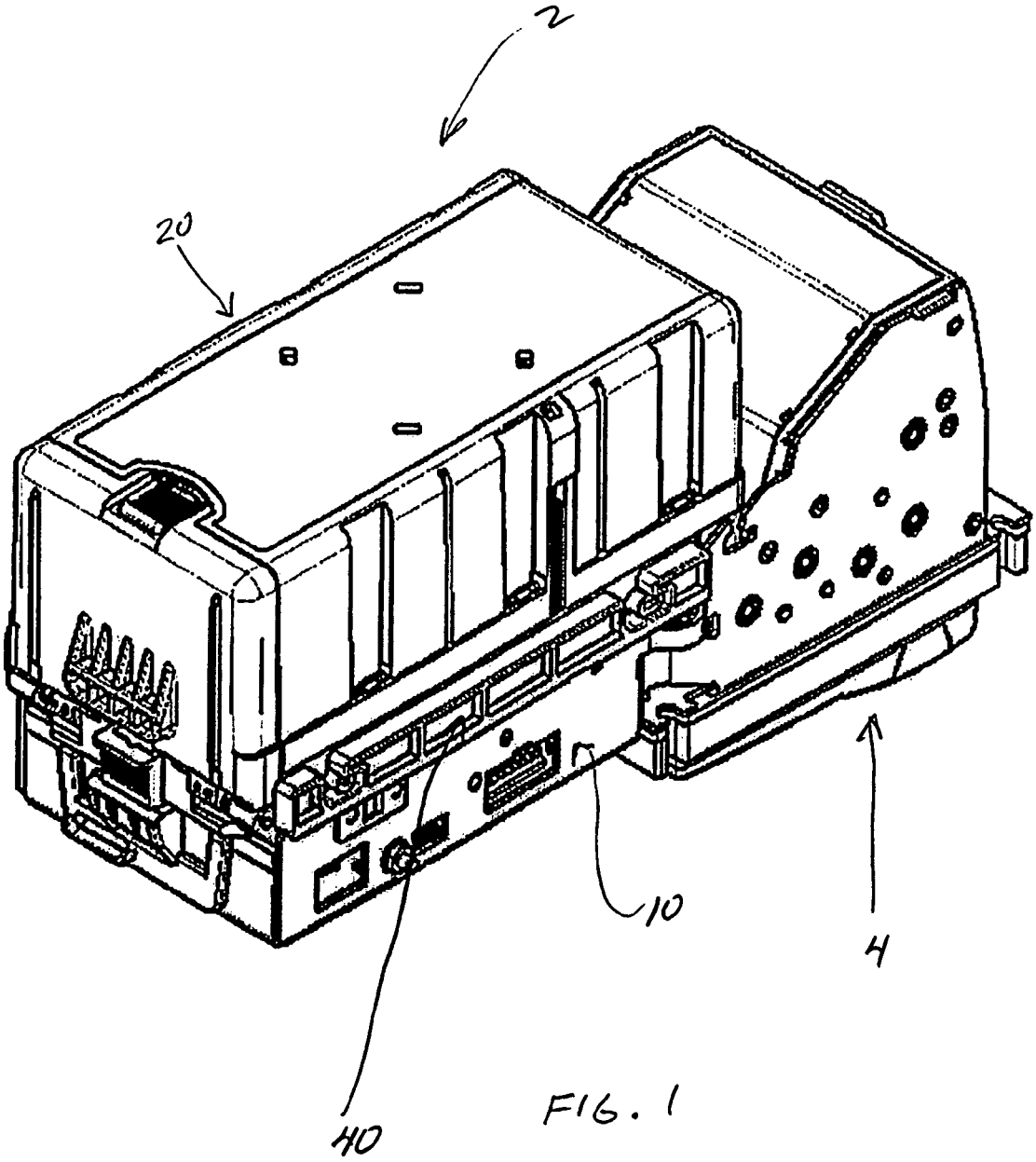
FIG. 1 is a perspective view of a banknote acceptor with a removable plastic cassette.

The banknote acceptor 2 includes a validator 4 secured within a body frame 10. The non locked banknote cassette 20 is shown secured within the body frame 10. Also received within the body frame 10 is the removable stacker 40.

Figure 2:
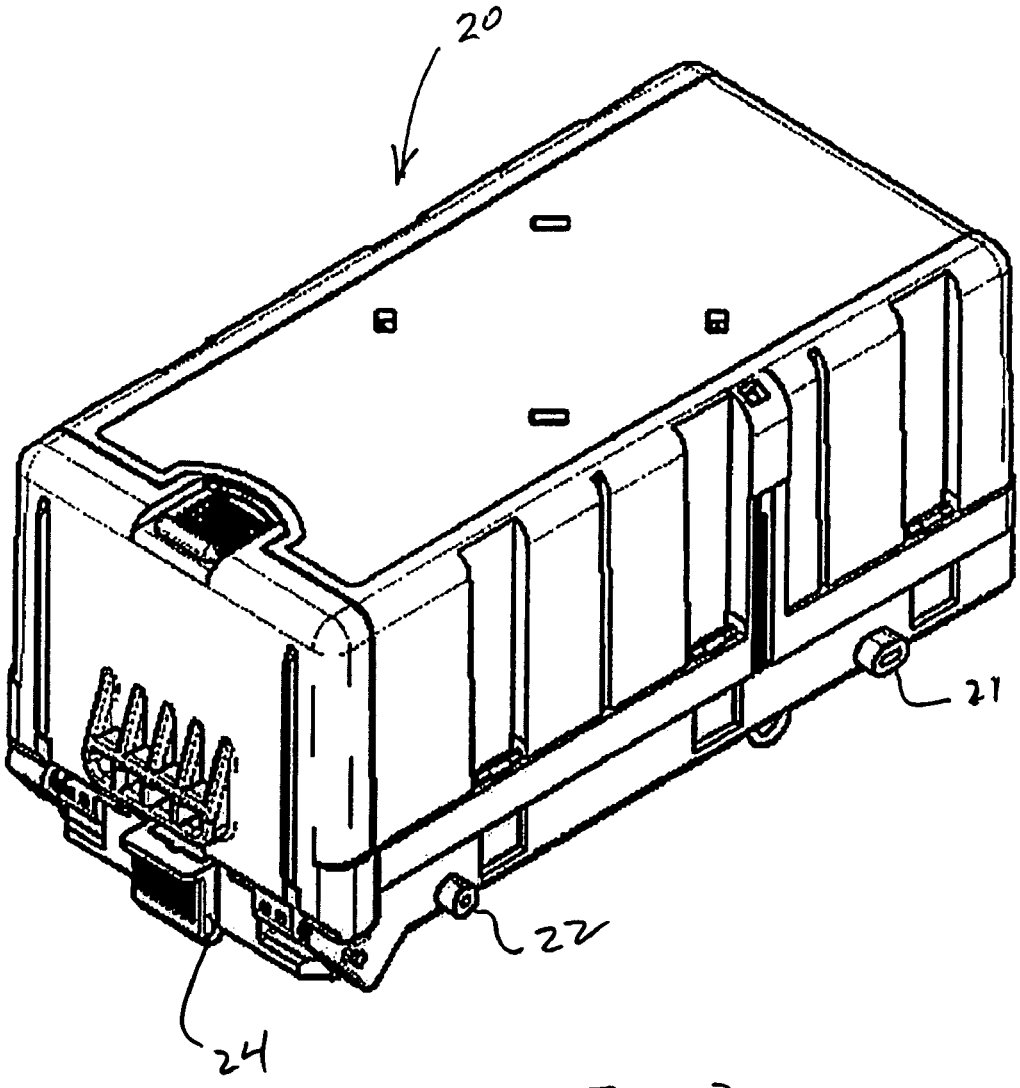
FIG. 2 is a perspective view of the removable plastic cassette.
Figure 3:
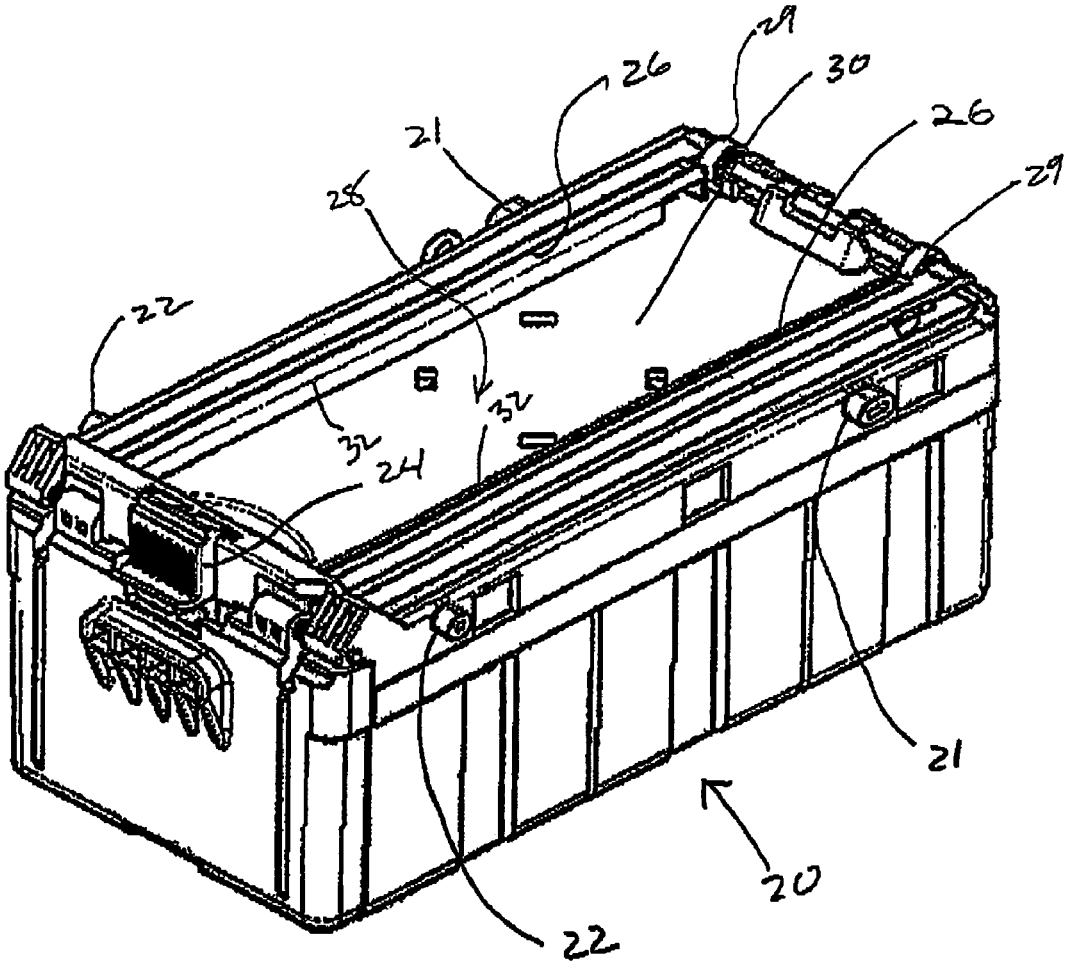
FIG. 3 is a perspective view of the removable plastic cassette showing the large access port through which banknotes are forced to be stacked interior to the cassette.

The perspective views of FIGS. 2 and 3 show details of the removable banknote cassette 20. The banknote cassette includes on the sides thereof, a pair of locking lugs 21 and 22 which are used to secure the non locked banknote cassette 20 within the banknote acceptor. The banknote cassette 20 also includes a locking tab 24 which cooperates with the locking tab port 50 of the removable stacker 40 shown in FIG. 4.

The non locked banknote cassette 20 as shown in FIG. 3 includes a large port 28 through which banknotes are pushed by the removable stacker for storage within the banknote cassette.

In FIG. 3, the banknote cassette has not yet received the banknotes and thus, the bias plate 30 is exposed within the large port 28. The idler wheels 29 of the banknote cassette cooperate with drive wheels secured within the body frame 10 for positioning a banknote that is about to be added to the banknote cassette, generally centered over the large port 28 with the side rail members 32 separating any received banknotes within the cassette from the banknote that is to be added to the stack. The stacker mechanism of the removable stacker 40 passes through the port 28 and forces a banknote to pass through the port and be retained within the banknote cassette due to engagement with the side rail members 32.

The non locked banknote cassette 20 is often of a plastic material to reduce the cost thereof relative to a locked metal banknote cassette.

Figure 4:
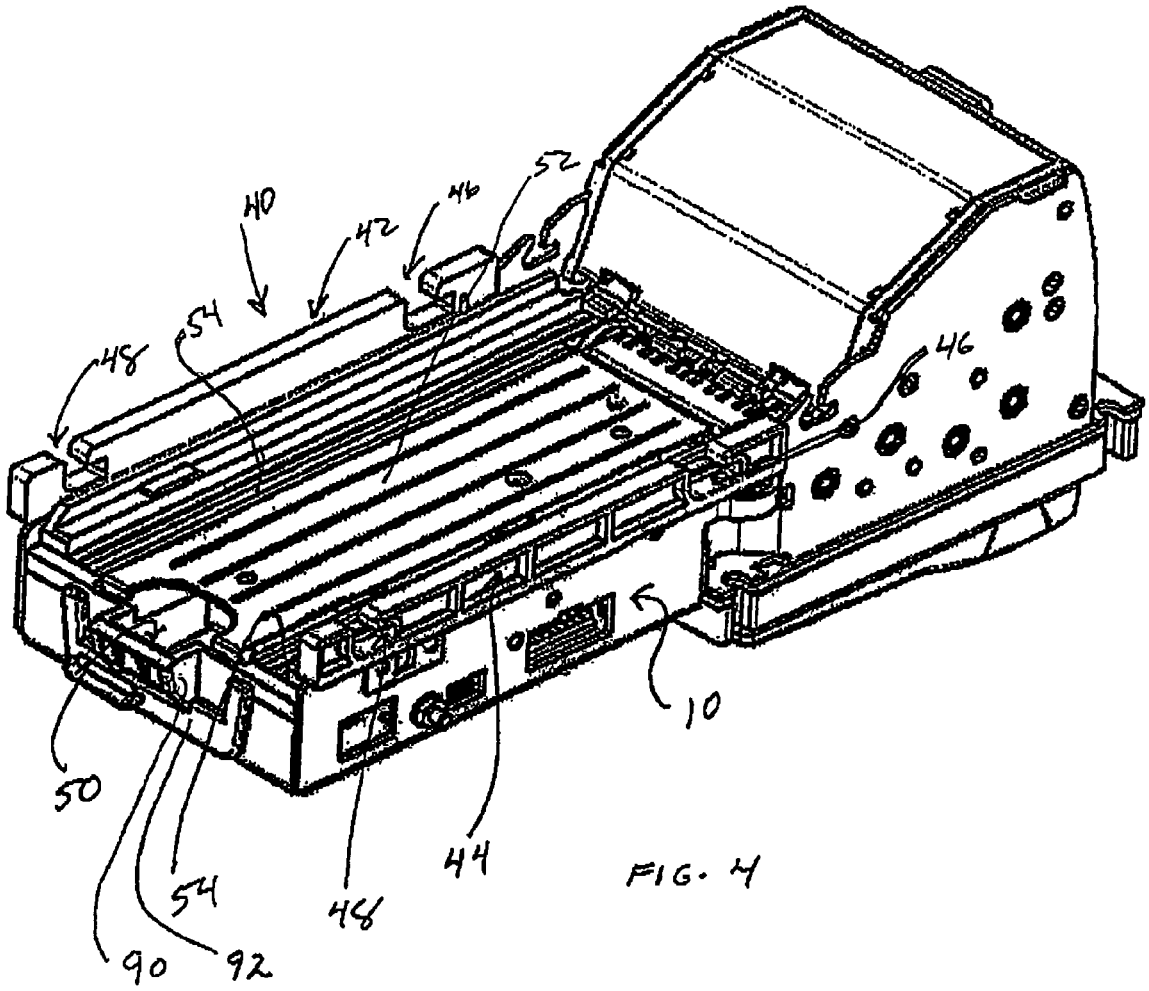
FIG. 4 is a perspective view of the banknote acceptor with the removable stacker secured in the banknote acceptor.

FIG. 4 shows the banknote acceptor 2 with the removable stacker 40 received within the body frame 10. In FIG. 4, the removable stackers shown in an initial position where a banknote accepted by the validator 4 would cover the stacker plate 52 with the banknote also partially overlapping with the guide rail members 54. These guide rail members 54 in cooperation with the side rail members 26 of the cassette, form a channel for receiving banknotes to be added to the banknote cassette.

Figure 5:
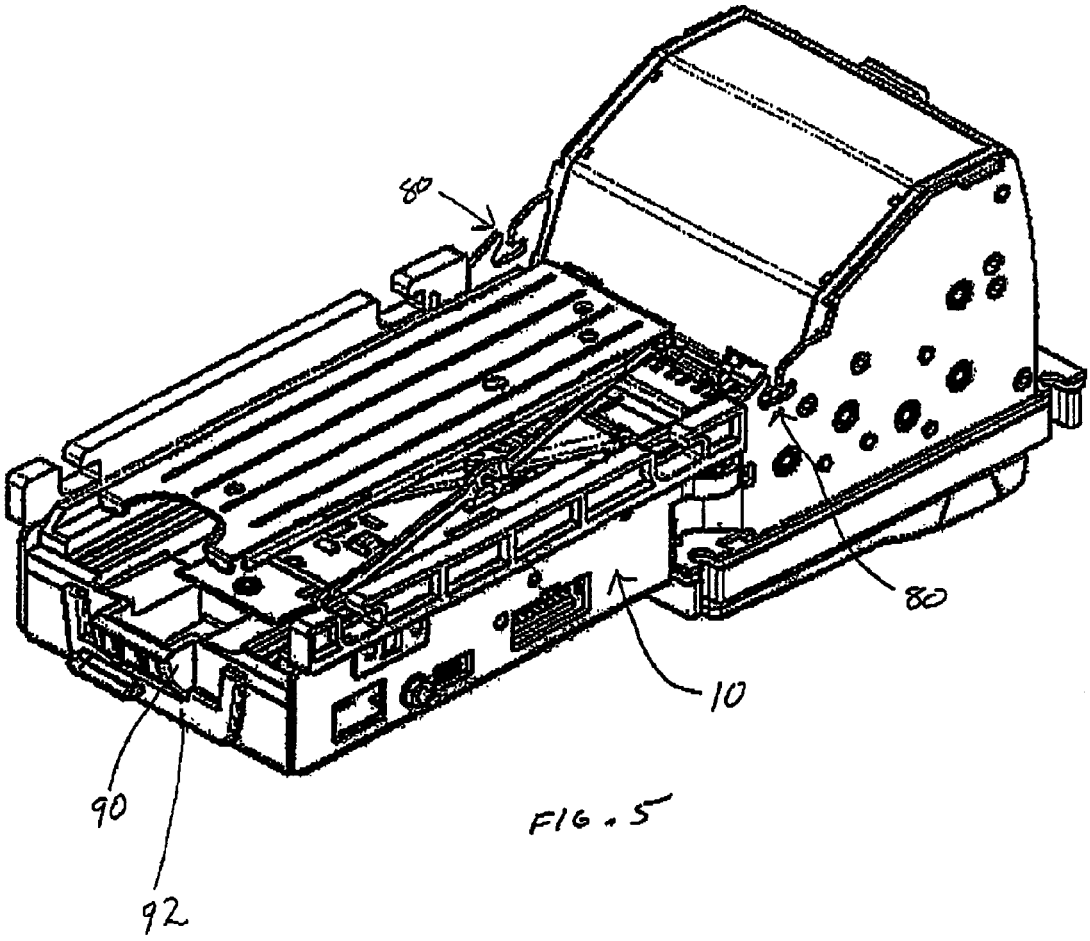
FIG. 5 is a perspective view of the banknote acceptor with the stacker mechanism shown in an extended position.

The stacker plate 52, when driven by the stacker mechanism as shown in FIG. 5, will force a banknote that is within the channel into the banknote cassette.

FIGS. 4 and 5 also show side rail members 42 and 44 of the removable stacker 40, including an upper locking slot 46 and a lower locking slot 48. These locking slots 46 and 48 receive the securing lugs 21 and 22 provided on the sides of the non locked banknote cassettes 20. The banknote once inserted in the removable stacker 40, is secured thereto by engagement of the locking tab 24 with the locked tab port 50 of the stacker mechanism. This arrangement includes the manual release for simple release of the banknote cassette from the stacker mechanism.

Figure 6:
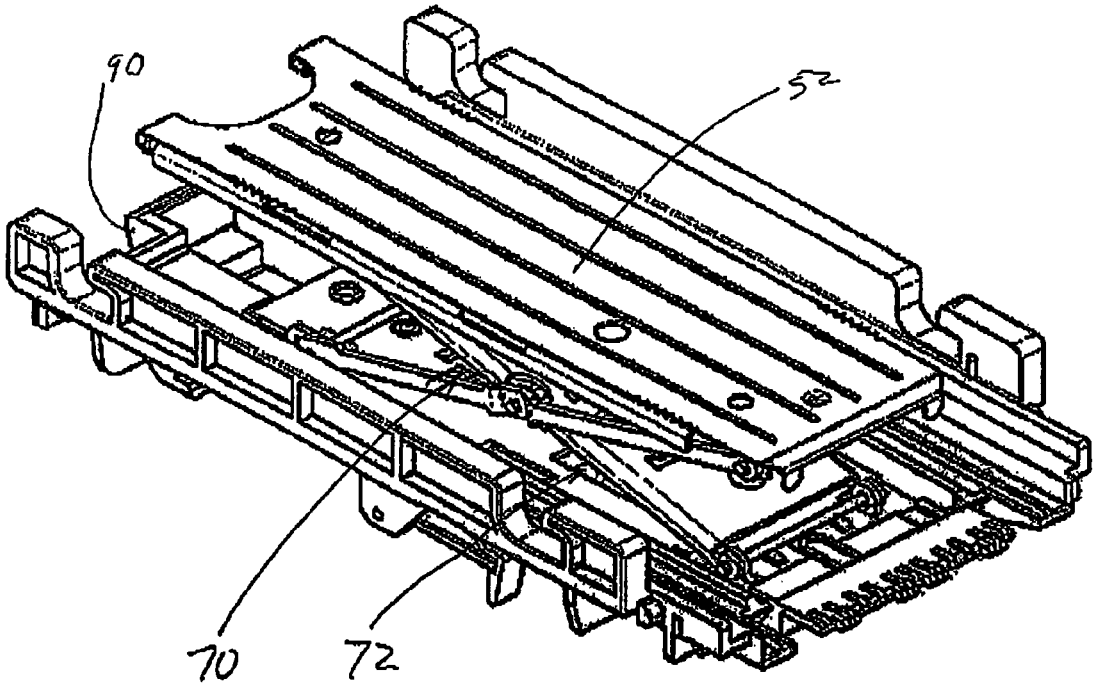
FIG. 6 is a perspective view of the removable stacker.

FIG. 6 shows the removable stacker 40 separated from the body frame 10. The stacker mechanism can be a separate component and if there is any problem with the actuating linkage 70 of the removable stacker 40, then a new stacker can be inserted in the body frame. The removable stacker 40 includes a number of plastic components and also includes a large drive port 72 to accommodate in this case, a cam mechanism used to drive the actuating linkage 70 connected to the stacker plate 52 between the one end position shown in FIG. 6 for forcing a banknote into the banknote cassette to the position of FIG. 4 where the stacker plate is positioned for receiving of a banknote to be added to the banknote cassette.

The removable stacker 40 provides a cost effective method for repair of a banknote acceptor if the stacker mechanism is not operating properly. The operator can merely remove the stacker mechanism and insert a new mechanism which cooperates with the drive arrangement within the body frame 10. A releasable latch is formed between the recess cavity 90 of the stacker and engaging member 92 of the body frame 10.

A further advantage of the banknote acceptor 2 shown in the drawings, is the capability of the banknote acceptor to also receive a lockable banknote cassette. Such lockable banknote cassettes include their own internal stacking mechanism having a similar stacking mechanism all internal to the cassette. Such lockable banknote cassettes also include a large drive port for engaging a drive member of the body frame 10.

The banknote acceptor 2 as shown in FIG. 5 can have the removable stacker 40 released from the body frame 10. The frame 10 also includes securing ports 80 that are adapted to receive securing lugs of the lockable banknote cassette. Once the banknote cassette has been partially received in the frame 10, it is then forced to an aligned position and includes a similar snap lock arrangement for engaging the frame 10. The drive member which drives the releasable stacker 40 will be aligned with, and drive the stacker mechanism within the lockable banknote cassette.

With this arrangement, a purchaser may initially buy the banknote acceptor 2, for use with the less expensive non locked banknote cassette 20. The purchaser may have a number of non locked banknote cassettes 20 and a substantial saving is realized, not only due to the use of the plastic material, however, each banknote cassette does not include its own stacking mechanism, as would be the case with a lockable banknote cassette.

With different applications of banknote acceptors, the requirements of the system may change. For example, there may be a concern with respect to changes in operating personnel and a higher security arrangement may be required. In such a case, the removable stacker 40 can be removed from the frame 10 and a lockable banknote cassette can be used with the validator.

With the present system, the purchaser has the ability to switch between lockable banknote cassettes and non locked banknote cassettes. It can also be appreciated that this type of change in configuration does not require a change in the validator 4 or the frame 10. The operator may therefore change the particular configurations of his validators, depending upon the particular application. The changeover does not require any specialized tools as the removable stacker is releasable from the frame 10, due to the latch arrangement defined between recess cavity 90 and engaging member 92 of the body frame 10.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A banknote acceptor comprising a validator, a removable banknote stacker supported below said validator and positioned to receive banknotes accepted by said validator; said banknote acceptor further including a non locked banknote cassette releasably engagable with said banknote acceptor and cooperating with said removable banknote stacker to receive an accepted banknote from said validator in an initial position intermediate said removable banknote stacker and said cassette with the accepted banknote movable by operation of said removable banknote stacker into said cassette; said removable banknote stacker when in engagement with said banknote acceptor being actuated by a drive member secured in said banknote acceptor; and wherein said banknote stacker is removable from said banknote acceptor independent of said drive member.

2. A banknote acceptor as claimed in claim 1 wherein said removable banknote stacker includes a latch releasably securing said removable banknote stacker to a body frame of said banknote acceptor.

3. A banknote acceptor as claimed in claim 2 wherein said non locked banknote cassette is releasably secured to said removable banknote stacker.

4. A banknote acceptor as claimed in claim 3 wherein said non locked banknote cassette includes securing lugs received in securing ports of said removable banknote stacker and a manually releasable latch; said manually releasable latch cooperating with said removable banknote stacker and said securing lugs to releasably secure said non locked banknote cassette to said removable banknote stacker.

5. A banknote acceptor as claimed in claim 1 wherein said banknote acceptor includes a body frame that supports said validator and said removable banknote stacker; said body frame with said removable banknote stacker removed includes securing ports for releasably engaging a locked banknote cassette having a stacker mechanism internal to said locked banknote cassette.

6. A banknote acceptor as claimed in claim 5 wherein said removable banknote stacker has a majority of injected molded plastic components.

7. A banknote acceptor as claimed in claim 6 wherein said removable banknote stacker includes opposed side members with each side member including first and second securing slots, said non locked banknote cassette including side securing lugs receivable in the first and second securing slots to form part of the releasable securement of said non locked banknote cassette to said removable banknote stacker.

* * * * *